US005471860A

United States Patent [19]

Collet et al.

[11] Patent Number: 5,471,860

[45] Date of Patent: Dec. 5, 1995

[54] APPARATUS FOR STRAIGHTENING AND ORIENTATING PROJECTIONS OR NIPPLES OF ANODES

[75] Inventors: Erwin Collet, Lunen; Paul Haverbeck, Selm; Alfred Marquart, Bergkamen; Roland Rathgeber, Neup, all of Germany

[73] Assignee: Westfalia Becorit Industrietechnik GmbH, Germany

[21] Appl. No.: 237,606

[22] Filed: May 3, 1994

[30] Foreign Application Priority Data

May 12, 1993 [DE] Germany ..... 43 15 808.0

[51] Int. Cl.[6] ..... B21D 3/16

[52] U.S. Cl. ..... 72/316; 72/293

[58] Field of Search ..... 72/316, 293, 381, 72/383–385, 412

[56] References Cited

U.S. PATENT DOCUMENTS 3,696,656 10/1972 Nara ..... 72/420
4,667,501 5/1987 Martin ..... 72/403
4,903,519 2/1990 Hukkanen ..... 72/412
4,903,520 2/1990 Hukkanen ..... 72/412
5,117,672 6/1992 Collet ..... 72/420

*Primary Examiner*—Daniel C. Crane
*Attorney, Agent, or Firm*—Samuels, Gauthier & Stevens

[57] ABSTRACT

Apparatus for straightening and orientating the deformed nipples of an anode employs framework through which each anode suspended by its anode rod is passed. A hollow casing with openings for receiving the nipples is raised relative to the framework to locate the nipples in the openings. A yoke of the anode is supported by pressure-pieces driven by self-locking spindle drives to engage the yoke from the outside and by support members engaging the yoke from the underside. The casing carries mechanisms each composed of piston and cylinder units with the piston rods and cylinders interconnected by yokes. One of these yokes has recesses for applying force to a central nipple and the other of these yokes carries a force-applying element with a socket for receiving the outermost nipples. The yokes and force applying elements are guided within the casing and serve to bend the nipples back into the desired orientation. Stops serve to control and limit the displacement of the piston and cylinder units.

18 Claims, 3 Drawing Sheets

APPARATUS FOR STRAIGHTENING AND ORIENTATING PROJECTIONS OR NIPPLES OF ANODES

FIELD OF THE INVENTION

The present invention relates to an apparatus for straightening and orientating projections or nipples disposed on a yoke at one end .of an anode rod of a metallic anode. Such anodes are used in electrolytic smelting plants where the nipples are inserted into carbon blocks to form anode assemblies. The carbon blocks are consumed during operation. It is quite usual for the nipples to be deformed after the spent carbon blocks are removed and to render the anodes suitable for re-use with fresh carbon blocks it is necessary to straighten the deformed nipples.

BACKGROUND TO THE INVENTION

Normally the projections or the nipples of anodes are arranged in three locations relative to the head or yoke of the end of the anode rod: namely a central location and at two outer locations relative to the axis of the rod. One or more projections are provided in each such location.

Apparatus for straightening and orientating the nipples of anodes .is known from DE-OS-4124211. This known apparatus employs plate-like force applying elements for engaging and bending the outermost nipples.

A general object of the present invention is to provide apparatus of improved construction able to straighten and orientate all the nipples while keeping the apparatus as simple and compact as possible.

SUMMARY OF THE INVENTION

According to the present invention there is provided apparatus for straightening and orientating projections or nipples of an anode, the nipples being disposed at one end of an anode rod and consisting of at least two outer nipples and at least one central nipple relative to the anode rod; said apparatus comprising frame means; means for guiding and supporting an anode relative to the frame means for a straightening and orientating treatment; drive mechanisms supported by the frame means on opposite sides of the axis of the anode rod of the anode; said mechanisms being equipped with force-applying elements displaceable transversally of the axis of the anode rod and engageable with said at least two outer nipples to exert force thereon and with further force-applying means disposed between said elements, said force-applying means being displaceable transversally of the axis of the anode rod and engageable with the said at least one central nipple to exert force thereon.

Thus, in contrast to the known apparatus, the additional force-applying means acts to straighten the central or internal nipple or nipples. The straightening and orientation of all the nipples may be carried out by operating the mechanisms simultaneously or successively. The additional force-applying means can be compactly arranged between the other force-applying elements and can take the form of simple pressure pieces designed to engage the central nipple or nipples from opposite sides. It is convenient to couple the force-applying means to the same drive as the force-applying elements.

In one constructional form, each mechanism employs a pair of hydraulic piston and cylinder units disposed in parallel with their cylinders and the piston rods respectively interconnected by yokes. One of said yokes supports the associated force-applying element of said mechanism and the other of the yokes supports or constitutes the further force-applying means.

This construction enables the outer nipples to be orientated and the central nipple to be orientated by charging the units to cause their extension. It is desirable to control and limit the displacement of the elements and force-applying means by the use of stops least some of which are adjustable.

It is generally expected that the force applied to the nipples will deform the nipples somewhat beyond the desired orientation so that the nipples will then spring back into the desired orientation after relief of the force due to the inherent resiliency of the metallic material from which the anode is made. The apparatus can be designed so that any inherent resiliency of the components, particularly the force-applying means, does not affect the operation of straightening and orientating the nipples.

As regards the actual contact between the nipples and the force-applied elements and force-applying means, it is preferable to have high-strength bearing surfaces on the latter-mentioned apparatus components. Conveniently, where the other yokes of the mechanisms engage directly on the central nipple or nipples, these yokes can have lined recesses. The force-applying elements can have apertures forming sockets for receiving the outer nipples and these sockets can be lined as with bushings.

According to a further advantageous feature of the invention, the force-applying elements and the further force-applying means are guided between upper and lower plates of a casing carrying the mechanisms and at least the upper plate is provided with openings for receiving the nipples. The force-applying elements can take the form of simple flat plates which are guided between upstanding walls extending between the upper and lower plates.

The hollow casing can be flat and relatively narrow and combined with the mechanisms as a structural sub-assembly raisable and lowerable as a whole relative to the frame means. Preferably, upstanding piston and cylinder units and telescopic guides can effect and guide the raising and lowering movements of the sub-assembly. The sub-assembly can be lowered into a non-operative position whilst an anode is passed into the apparatus; usually by being suspended by its anode rod transported as one of a series of such anodes. With the anode guided into place the sub-assembly is then raised to bring the nipples into location for their treatment. After the treatment has taken place the sub-assembly is lowered to release the anode and the next anode transferred into place.

It is desirable to support the anode rod or its head or yoke connecting the rod to the nipples whilst the mechanisms are operating. For this purpose, displaceable support means can be disposed above the mechanisms again on opposite sides of the anode rod. The support means may have shaped replaceable pressure pieces designed to engage on the anode yoke from the outside. The displaceable support means may be supported on the casing as further parts of the raisable and lowerable subassembly or mounted on the frame means in a fixed vertical location. The displaceable support means may be supplemented by adjustable or replaceable support members carried by the casing for engaging on the underside of the anode yoke. The displaceable support means are preferably displaced by means of self-locking spindle drives particularly hydraulic drives. The pressure pieces can thus be held in their supportive position by the self-locking action of the spindle drives.

The invention may be understood more readily, and various other aspects and features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Reference may be usefully made to DE-OS-4124211 mentioned previously to aid further understanding of the invention.

Figure 1:
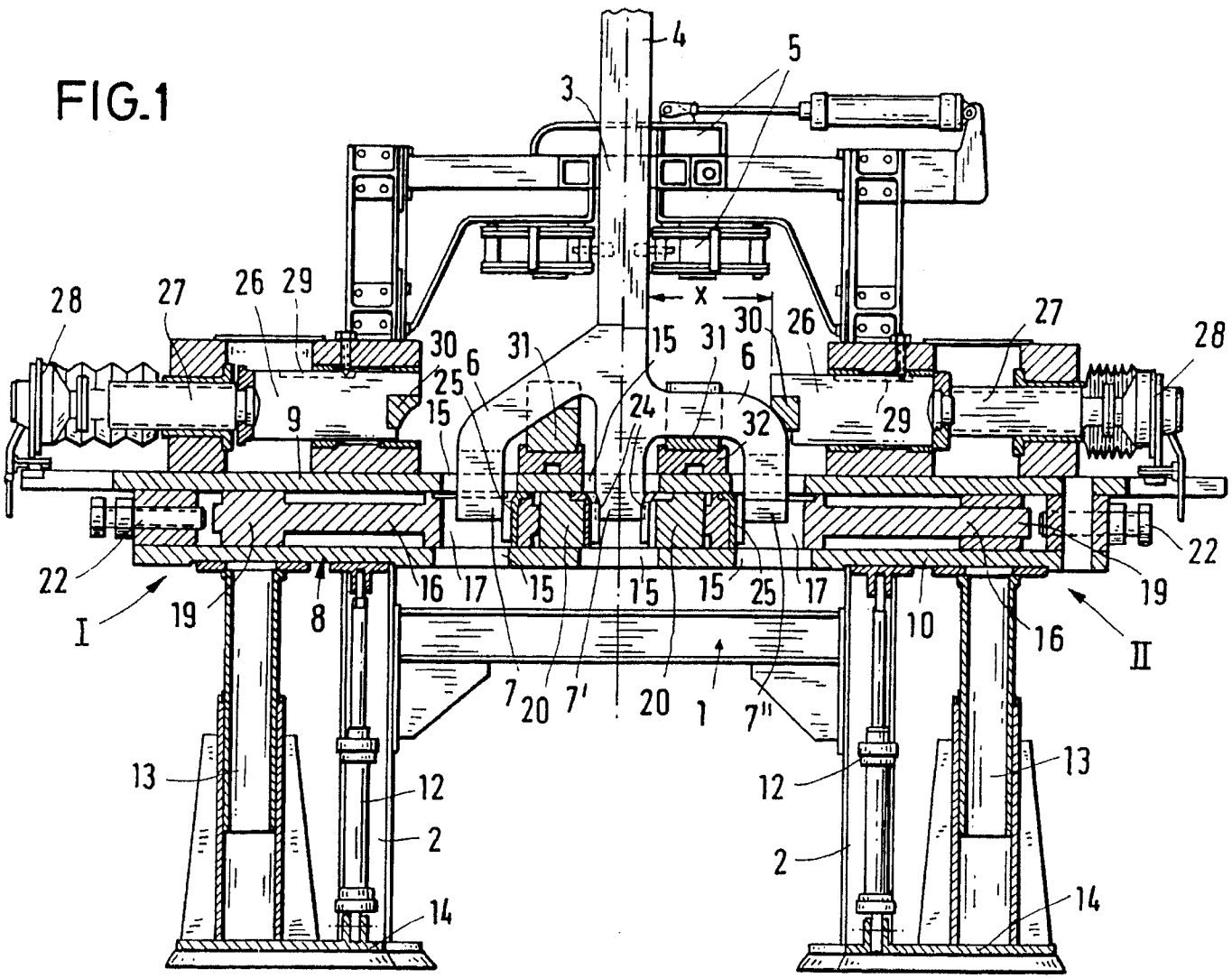
FIG. 1 is a vertical section through apparatus constructed in accordance with the invention.

As shown in the accompanying drawings, apparatus constructed in accordance with the invention has framework 1 of generally rectangular configuration which has four upstanding supports 2 arranged at the corners and anchored to the floor or ground. The framework 1 has a head region with a slot-like gap 3 for guiding the passage of anode rods 4 suspended by a chain or shackle of a conveyor or the like. Each anode rod 4 passing through the gap 3 is held in a desired orientation by means of an hydraulically operated appliance 5. The appliance 5 is shown in FIG. 1 in its lowered working position but can be displaced into a raised inoperative position. FIG. 1 also shows the anode rod 4 has at its lower end three projections or nipples 7, 7', 7" connected to a common yoke 6. The actual shape of the anode end piece 6, 7, 7', 7", can take a variety of forms and FIG. 1 shows a hybrid configuration with the yoke 6 inclined in relation to the axis of the rod 4 at the left-hand side and the yoke 6 perpendicular to the axis of the rod 4 at the right-hand side. Anodes with either configuration can be orientated with the apparatus as described and illustrated. The number of nipples is also variable and two parallel rows of three nipples 7, 7', 7" making six nipples in all can be connected to the yoke 6. In both cases there is one or two central or internal nipples 7' and two or four outer or external nipples 7, 7". In practice, the anodes to be treated are usually deformed with the external nipples 7, 7" typically bent inwardly towards the internal nipple or nipples 7' whilst the or each internal nipple 7' is typically bent outwards towards one or other of the external nipples 7, 7".

Figure 2:
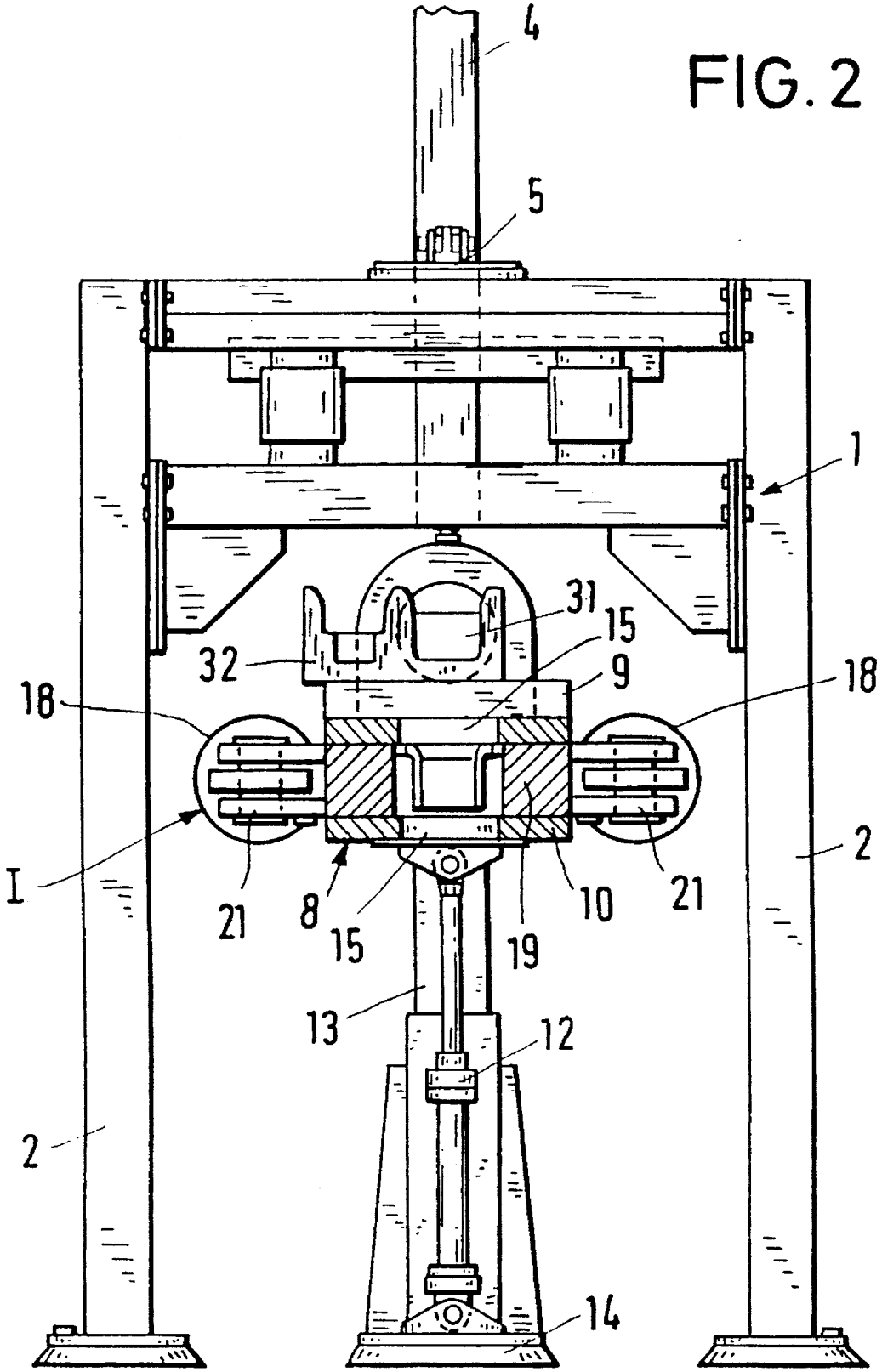
FIG. 2 is a part-sectional front view of the. apparatus shown in FIG. 1

The deformed nipples 7, 7', 7" are orientated and straightened by means of two mechanisms I, II arranged symmetrically to the axis of the rod 2 and supported on a common flat casing 8. The casing 8 is composed of an upper cover or plate 9 and a lower cover or plate 10 interconnected by vertical walls 11 (FIG. 2). The casing 8 is raisable and lowerable with respect to the framework 1 with the laid of hydraulic units 12 mounted between the casing 8 and foot pieces 14. Telescopic guides 13 also arranged between the casing 8 and the foot pieces 14 guide the movement of the casing 8.

The covers plates 9, 10 have openings 15 for receiving the individual nipples 7, 7', 7" and these openings 15 are sufficiently large to accommodate the nipples 7, 7', 7" even when deformed Each mechanism I, II has a force-applying orientation element 16 which is slidably displaceable between the covers 9, 10. Each element 16, which is guided by the covers 9, 10 and between the walls 11, is itself of plate-like form and has an aperture 17 acting as a nipple socket for receiving and engaging with one of the external nipples 7, 7". As with the openings 15, the apertures 17 are of sufficient size to accommodate the external nipples 7, 7" even when deformed. Each mechanism I, II also has a drive which, as shown particularly in FIG. 3, takes the form of a pair of parallel horizontally-disposed hydraulic piston and cylinder units 18. The cylinders of the units 18 are interconnected by an external yoke 19 while the piston rods are interconnected by an internal yoke 20 which serves as further force-applying means for orientating the internal nipple(s) 7'. The yokes 19, 20 are coupled to the units 18 with the aid of flexible pivot joints 21.

Figure 3:
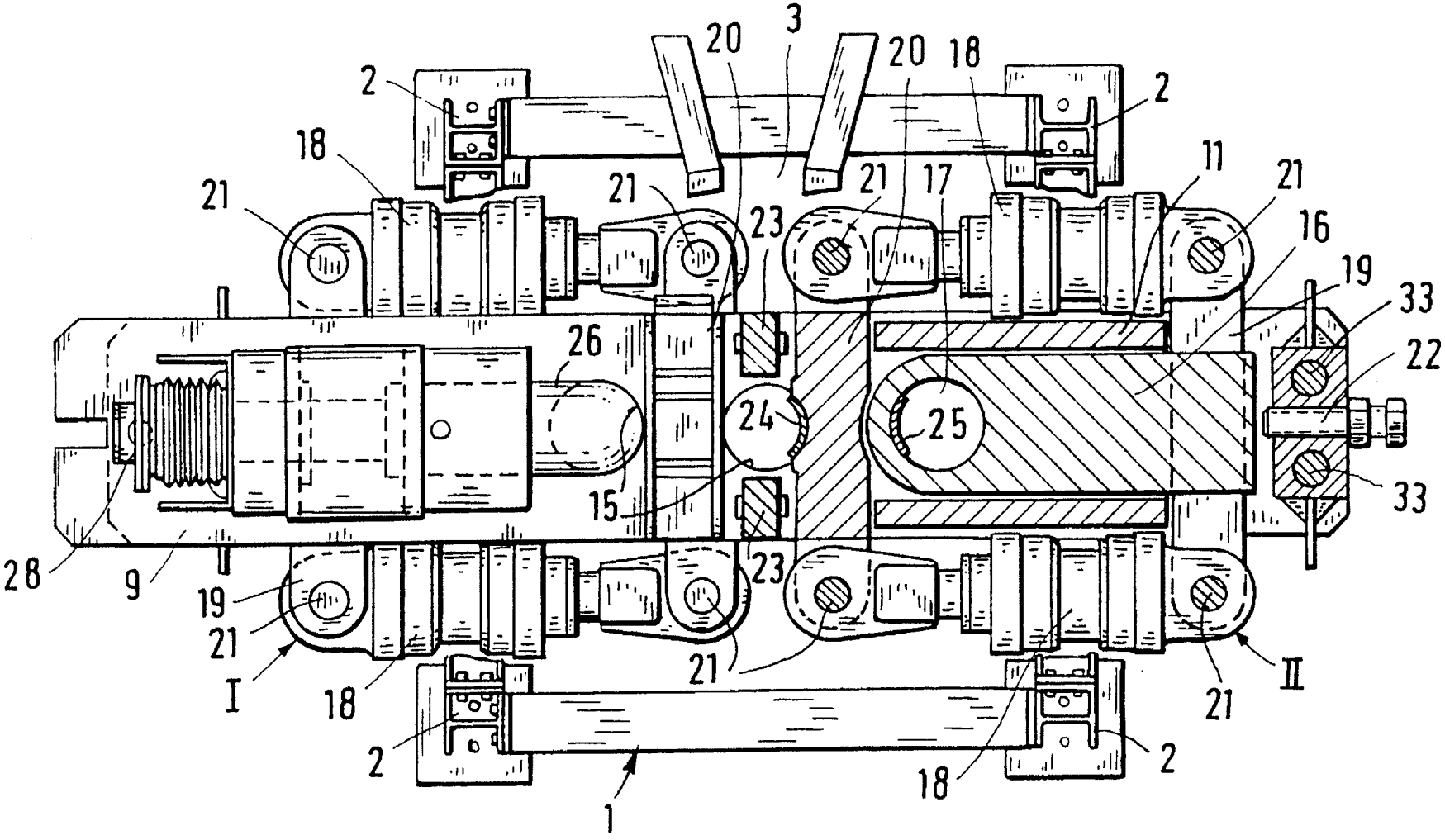
FIG. 3 is a part-section of the apparatus shown in FIGS. 1 and 2 with the head region of the frame omitted.

FIGS. 1 and 3 show that the yokes 19, 20 pass transversally through the casing 8 and are guided therein. The associated orientation element 16 is rigidly fixed to the yoke 19 of each mechanism I, II.

The yokes 20 are arranged between the orientation elements 16 in the same horizontal plane. Stop members 22 on the framework 1 have adjustable screw-threaded bolts and serve to engage and locate the position of the yokes 19 and/or the orientation elements 16. Fixed stop members 23 on the framework 1 likewise serve to engage and locate the position of the yokes 20.

The yokes 20 have recesses with high-strength wear-resistant linings 24 for pressure contact with the nipple(s) 7'. Similarly the sockets 17 defined by the elements 16 have a high-strength wear resistant linings 25 or bushings for pressure contact with the nipples 7', 7".

Above each of the mechanisms I, II, there is a support means with a pressure piece 26, conveniently a strong thrust bolt, guided for movement in the relation to the framework 1 with the aid of guides 29. The pressure pieces 26 are movable in a horizontal direction transversally of the anode rod 4 towards and away from the yoke 6 of the anode. The pressure pieces 26 are each moved with the aid of a self-locking spindle drive 27 employing a hydraulic motor 28. The pressure pieces 26 have arcuate faces with shaped inserts 30 adapted to conform with the external profile of the yoke 6 and/or the external nipples 7, 7". The pressure pieces 26 with their drives 27, 28 can be mounted on the casing 8 as shown although these components can be mounted on the framework 1 to stay in a fixed position.

In FIG. 1, the pressure piece 26 at the right hand-side is depicted in its supporting position engaging with the anode end region while the pressure piece 26 at the left-hand side is depicted in its in-operative position free from contact with the anode.

During the orientation and straightening treatment performed by the apparatus, the pressure pieces 26 are held against the anode end region by means of the spindle drives 27 so that the anode end piece is supported from the outside. On the upper side of the casing 8 i.e. on the upper cover 9, there are additional support members 31 for supporting the anode yoke 6 or end piece from the inside. The members 31 are located on sliders 32 which can be moved horizontally transverse to the working stroke of the units 18 to engage with stops in their supportive positions. The support members 31 employ replaceable lining inserts inserted into pockets and shaped to conform with the internal profile of the yoke 6.

The operation of the apparatus is as follows:

When the casing 8 is lowered an anode is transported and received in the gap 3 and the rod 4 thereof is centred by means of the appliance 5. The casing 8 is now raised along with the mechanisms I, II by means of the units 12 into the working position shown in FIG. 1 The nipples 7, 7', 7" are received in the openings 15 and the external nipples 7, 7" engage in the sockets 17 of the elements 16. The central nipple 7' engages generally between the recesses 24 of the yokes 20.

The pressure pieces 26 are now set to engage on the yoke 6 or the anode end region from the outside. Since the relative position of the nipples and the anode rod of correct orientation have certain tolerances this can best be accomplished by moving one of the pressure pieces 26 by means of its spindle drive 27, 28 towards the side of the yoke 6 and nipple 7" as shown at the right-hand side of FIG. 1. The one pressure piece 26 is moved to adopt a set distance x between the anode rod 4 and the shaped insert 30 determined by the known parameters of an anode. The other pressure piece 26 is then displaced to engage on the yoke 6 or the anode end region so the yoke 6 is reliably held between the pressure pieces 26. The support members 31 are now set into position to support the yoke internally from the underside. To achieve this the sliders 32 are displaced to bring the inserts of the members 31 into contact with the yoke 6 as represented in FIG. 1.

With the anode thus positioned and supported the straightening and orientation of the nipples 7, 7', 7" can proceed but process sequences and steps can take place in different ways. For example, the units 18 of the mechanism II can be hydraulically operated first to extend and bring the yokes 20, 19 into contact with the stop members 22, 23. If the central nipple 7' is deformed towards the mechanism II the recess 24 of the yoke 20 will urge the nipple 7' back into the correct orientation and if the nipple 7" is deformed towards the mechanism I the socket 17 of the element 16 will urge the nipple 7" back into the correct orientation. The stop members 22, 23 are preferably so adjusted that the permitted displacement of the units 18 is rather more than that necessary to compensate for the deformation of the nipples 7', 7". Thus the nipples 7',7" will be bent back further than the necessary compensation but will spring back into the desired orientation when the nipples 7', 7" are released. The same treatment can then be applied on the nipples 7, 7' by operating the units 18 of the mechanism I. If the central nipple 7' is deformed towards the mechanism I then the operation of the units 18 of the mechanism II will only straighten the nipple 7" and the nipple 7' will be straightened by the subsequent operation of the units 18 of the mechanism I.

In other process sequences, the mechanism I can operate first and the other mechanism II last or both mechanisms I, II can operate together at least over part of their cycle. When the straightening and orientation operations have been completed and with the yokes of both mechanisms I, II braced between the stop members 22, 23 the casing 8 can be lowered along with the mechanisms I, II by means of the units 12 so that the now-treated anode can be moved out of the gap 3 and a new anode received in the gap 3.

In the case where the anode has say six nipples the openings 15, the sockets 17 and the recesses 24 would be increased in number accordingly.

In the design and construction of the apparatus it is advantageous if the inherent resiliency of the overall apparatus is substantially eliminated. Despite this, the apparatus as described is comparatively simple and compact and is not particularly heavy. The apparatus is also easy to maintain and service and can be disassembled and erected without difficulty. For this purpose, the frame parts carrying the stops 22 can be removable for example by releasing bolts 33 shown in FIG. 3. The elements 16 on the yokes 19 can then be withdrawn and removed from the casing 8 after releasing the joints 21.

The orientating mechanisms I, II can together form a structural sub-assembly which is itself detachable as a whole from the framework 1.

We claim:

1. Apparatus for straightening and orientating projections or nipples of an anode, the nipples being disposed at one end of an anode rod and consisting of at least two outer nipples and at least one central nipple relative to the anode rod; said apparatus comprising frame means; means for guiding and supporting an anode relative to the frame means for a straightening and orientating treatment; drive mechanisms supported by the frame means, on opposite sides of the axis of the anode rod of the anode; said mechanisms being equipped with force-applying elements displaceable transversally of the axis of the anode rod and engageable with said at least two outer nipples to exert force thereon and with further force-applying means disposed between said elements said force-applying means being displaceable transversally of the axis of the anode rod and engageable with said at least one central nipple to exert force thereon; and each mechanism employs a pair of parallel hydraulic piston and cylinder units wherein the cylinders and piston rods are respectively interconnected by yokes, one of said yokes supporting the force-applying element of said mechanism and the other of the yokes supporting or constituting the further force-applying means.

2. Apparatus according to claim 1, wherein the force-applying means of each mechanism is coupled directly to the displaceable element thereof.

3. Apparatus according to claim 1, and further comprising stop members supported by the frame means and engageable with the other yokes of the mechanisms to limit the outward displacement thereof towards the axis of the anode rod.

4. Apparatus according to claim 1, and further comprising adjustable stop members supported by the frame means and disposed to limit the outward displacement of the force-applying elements away from the axis of the anode rod.

5. Apparatus according to claim 3 and further comprising adjustable stop members supported by the frame means and disposed to limit the outward displacement of the force-applying elements away from the axis of the anode rod.

6. Apparatus according to claim 1 wherein the other yoke of each mechanism has a recess for bearing against said at least one central nipple.

7. Apparatus according to claim 6, wherein each recess has a wear-resistant high strength lining.

8. Apparatus according to claim 1, wherein the force-applying elements have apertures forming sockets for receiving said at least two outer nipples.

9. Apparatus according to claim 8, wherein each socket has a wear-resistant high strength lining.

10. Apparatus according to claim 1, wherein the force-applying elements and the further force-applying means are guided between upper and lower plates of a casing carrying the mechanisms and at least the upper plate is provided with openings for receiving the nipples.

11. Apparatus according to claim 10, wherein the force-applying elements are flat plates which are guided between upstanding walls extending between the upper and lower plates.

12. Apparatus according to claim 1, wherein the mechanisms are combined to form a structural sub-assembly which is raisable and lowerable relative to the frame means.

13. Apparatus according to claim 12, wherein the sub-assembly employs a hollow casing in which the force-applying elements and the further force-applying means are guided for displacement and the hollow casing is carried by piston and cylinder units which serve to raise and lower the sub-assembly.

14. Apparatus according to claim 13 and further comprising telescopic guides for guiding the raising and lowering movements of the sub-assembly.

15. Apparatus according to claim 13, wherein the subassembly further comprises displaceable support means disposed above the mechanisms on opposite sides of the anode rod and engageable with the anode to support the anode during the straightening and orientating treatment.

16. Apparatus according to claim 10 and further comprising adjustable support members carried by the casing for engaging and supporting the underside of a yoke of the anode interconnecting the nipples and the anode rod.

17. Apparatus for straightening and orientating projections or nipples of an anode, the nipples being disposed at one end of an anode rod and consisting of at least two outer nipples and at least one central nipple relative to the anode rod; said apparatus comprising frame means; means for guiding and supporting an anode relative to the frame means for a straightening and orientating treatment; drive mechanisms supported by the frame means, on opposite sides of the axis of the anode rod of the anode; said mechanisms being equipped with force-applying elements displaceable transversally of the axis of the anode rod and engageable with said at least two outer nipples to exert force thereon and with further force-applying means disposed between said elements said force-applying means being displaceable transversally of the axis of the anode rod and engageable with said at least one central nipple to exert force thereon; displaceable support means disposed above the mechanisms on opposite sides of the anode rod and engageable with the anode to support the anode during the straightening and orientating treatment and wherein the support means are provided with self-locking spindle drives.

18. Apparatus for straightening and orientating projections or nipples of an anode, the nipples being disposed at one end of an anode rod and consisting of at least two outer nipples and at least one central nipple relative to the anode rod; said apparatus comprising frame means; means for guiding and supporting an anode relative to the frame means for a straightening and orientating treatment; drive mechanisms supported by the frame means, on opposite sides of the axis of the anode rod of the anode; said mechanisms being equipped with force-applying elements displaceable transversally of the axis of the anode rod and engageable with said at least two outer nipples to exert force thereon and with further force-applying means disposed between said elements said force-applying means being displaceable transversally of the axis of the anode rod and engageable with said at least one central nipple to exert force thereon; displaceable support means disposed above the mechanisms on opposite sides of the anode rod and engageable with the anode to support the anode during the straightening and orientating treatment wherein the support means is provided with replaceable shaped pressure-pieces for engaging with a yoke of the anode interconnecting the nipples and the anode rod.

* * * * *